US005718613A

United States Patent [19]

Nakamura

[11] Patent Number: 5,718,613

[45] Date of Patent: Feb. 17, 1998

[54] MARINE HYDRAULIC TILT AND TRIM CONTROL

[75] Inventor: Daisuke Nakamura, Hamamatsu, Japan

[73] Assignee: Sanshin Kogyo Kabushiki Kaisha, Hamamatsu, Japan

[21] Appl. No.: 623,453

[22] Filed: Mar. 28, 1996

[30] Foreign Application Priority Data

Mar. 28, 1995 [JP] Japan ..... 7-094403

[51] Int. Cl.[6] ..... B63H 21/26

[52] U.S. Cl. ..... 440/61

[58] Field of Search ..... 440/61, 53; 92/22, 92/23, 65, 165 R, 51–53

[56] References Cited

U.S. PATENT DOCUMENTS 5,529,519 6/1996 Nakamura et al. ..... 440/61

*Primary Examiner*—Jesus D. Sotelo

*Attorney, Agent, or Firm*—Knobbe, Martens, Olson & Bear LLP

[57] ABSTRACT

An improved tilt and trim device for a marine propulsion unit that permits effective tilt and trim movement through a compound tilt and trim cylinder. A latching arrangement is provided between elements of the cylinder so as to minimize the number of internal valves and valve actuators to simplify the construction from those employed in the prior art.

20 Claims, 8 Drawing Sheets

MARINE HYDRAULIC TILT AND TRIM CONTROL

BACKGROUND OF THE INVENTION

This invention relates to a marine hydraulic tilt and trim control and more particularly to an improved hydraulic tilt and trim control system that is particularly adapted for use in controlling marine outboard drives.

As is well known in many types of marine propulsion units, there is provided a hydraulic motor assembly that is interposed between the outboard drive portion of the propulsion system and the watercraft transom. This hydraulic mechanism provides a number of purposes. The first of these purposes is to permit the outboard drive to pop up when an underwater obstacle is struck so as to avoid damage to the lower unit. Once the underwater obstacle is cleared, the weight of the outboard drive returns it to its previous trim adjusted position.

In addition to this shock absorbing function, the shock absorbing mechanism is also constructed so as to preclude the outboard motor from popping up when operated in reverse mode. That is, the pressure at which the shock absorber valve opens is chosen to be low enough to permit adequate shock absorbing when underwater obstacles are struck, but high enough to resist the popping up action when operating in reverse drive.

The functions, as aforenoted, can be achieved with relatively conventional shock absorbers. However, it is also desirable to provide an arrangement wherein the marine propulsion unit can be hydraulically trimmed when operating under power. In addition, the hydraulic mechanism may also be employed for tilting the outboard drive up out of the water when not in use or for other purposes, such as inspection, etc.

Obviously, in order to permit trimming when operating under power, the hydraulic motor must provide large forces. This can be easily accomplished by providing relatively large effective piston areas over which the hydraulic pressure operates. However, these types of mechanisms, although providing good hydraulic force for trim operation, are very slow in tilt up operation.

Therefore, it has been proposed to employ one hydraulic motor that operates to provide the trim adjustment. This hydraulic motor has a relatively large diameter piston and, thus, has a relatively low stroke for a given fluid displacement. In addition, a smaller bore, but longer stroke, tilt fluid motor is also coupled to the outboard drive for effecting the tilt up operation. Thus, high speed tilting can be accomplished without loss of power for trim operation. These mechanisms are, however, quite complicated and require several fluid motors and control valve arrangements so as to actuate the proper motor when the trim or tilt is required.

There have been proposed, therefore, compound hydraulic motors wherein there is provided a single external cylinder. A trim cylinder is slidably supported in this outer cylinder and it itself defines an internal cavity in which a tilt piston is provided. Basically, these systems operate by effecting hydraulic pressure actuation of both the trim and tilt cylinders simultaneously for a portion of the stroke during which the trim movement is accomplished. The trim cylinder is then held and the tilt piston, which has a smaller effective piston area, is operated for tilt up operation.

A highly effective arrangement of this type is disclosed in the co-pending application filed in the name of the inventor hereof and Masahiko Iida entitled "Hydraulic Power Tilt and Trim Device," Ser. No. 08/304,947 filed Sep. 13, 1994 and assigned to the assignee hereof. That system is highly effective in that it reduces and simplifies the hydraulic control circuit. That is, by way of a unique latching system for holding the trim cylinder in position, it is possible to provide merely an on-off or two-way control valve for pressurizing the cylinder to achieve both the trim and tilt operation.

However, there are certain facets of that construction which can be improved upon as will be described by particular reference to FIG. 1, which is a schematic showing, in the five views thereof (A–E) the conditions at fully tilted and trimmed down position through intermediate positions to a fully trimmed up position shown in FIG. 1C and a fully tilted up position shown in FIG. 1E.

This prior art type of mechanism is indicated generally by the reference numeral 11 in these figures and is connected between a marine outboard drive, which may either constitute the outboard drive portion of an inboard-outboard drive or an outboard motor per se, in a manner which will be described later by reference to the detailed description of the preferred embodiments of the invention and, particularly, FIG. 2.

The combined tilt and trim fluid motor 11 includes an outer cylindrical housing assembly, indicated generally by the reference numeral 12 which has an integral trunion 13 having an opening 14 to pass a pivot pin for pivotal connection to one of the marine outboard drive and the transom of the associated watercraft, in this case the latter.

The cylinder 12 defines an internal cavity 15 in which a trim cylinder 16 is slidably supported. The trim cylinder 16, in turn, divides the cylinder bore 15 of the cylinder housing 12 into an upper chamber 17 and a lower chamber 18. Suitable connections (not shown) communicate the chambers 17 and 18 with a hydraulic pressure circuit for pressurizing either the chamber 18 or 17 and depressurizing the other chamber, in a manner which will be described.

A tilt piston 19 is slidably supported within a bore 21 of the trim cylinder 16. The tilt piston 19 has affixed to it a piston rod 22 that extends through openings in the end of the trim cylinder 16 and the outer cylinder 23. A trunion 23 is provided on the exposed end of the piston rod 22. The trunion 23 has a bore 24 that is adapted to pass a pin (not shown) for providing a pivotal connection to the remaining component of the outboard drive or transom of the associated watercraft (in this case, the former).

Positioned in the trim cylinder bore 21 below the piston 19 is a floating piston 25. The floating piston 25 is retained in the bore 21 below the tilt piston 19 by means that include a retainer device 26. A latch operating mechanism 27 is interposed between the retainer device 26 and the floating piston 25 and cooperates with a plurality of detent balls 28. These detent balls 28 are adapted to engage corresponding recesses 29 in the outer cylinder 12 at the end of the trim stroke for locking the trim cylinder 16 in position.

A shock absorber valve, indicated by the reference numeral 31, is carried by the tilt piston 19 and permits flow from the chamber formed above the tilt piston 19 within the trim cylinder bore 21 to the area between the trim piston 19 and the floating piston 25. When an underwater obstacle is struck, the tilt piston 19 will be urged upwardly and, if sufficient force is applied to open the shock absorber 31, fluid is displaced from the chamber in the trim piston cylinder bore 21 to the area between the tilt piston 29 and the floating piston 25. When this occurs, less fluid will be displaced from above the tilt piston 19 than below it and the floating piston 25 may move slightly upwardly.

Displacement of fluid from the chamber above the tilt piston 19 within the trim cylinder bore 21 is precluded by a check valved passageway 32. This check valved passageway permits the piston 19 to act as a conventional shock absorber, but will open under certain conditions as will be described. In fact, this construction is one of the disadvantages of the prior art type of construction. That is, and as will become apparent, the operation and positioning of the check valve 32 adds cost to the assembly. In addition, because of the need to provide accurate control of foreign particles which may enter the fluid can also adversely affect the operation.

Once the underwater obstacle, which has been struck and has caused the popping up action has been cleared, the tilt piston 19 may move downwardly through the opening of a let down valve 33 which opens at a substantially lower pressure than the shock absorber valve 31. The let down valve 33 provides no significant damping and can be opened merely by the weight of the outboard drive acting on the tilt piston 19.

Describing now the trim and tilt operation with the prior art of construction, if the operator desires a trim up operation, the hydraulic mechanism, aforenoted, is pressurized so that the chamber 18 below the floating piston 25 and trim cylinder 16 will be pressurized. At the same time, the chamber 17 is depressurized by opening it to return.

When the chamber 18 is pressurized, the fluid pressure will act upon the lower face of the trim cylinder 16 and also on the floating piston 25 and tilt piston 19 to cause this assemblage to move upwardly as shown in FIG. 1B to a desired trim adjusted position. When the desired position is reached, then the pressurization is discontinued and the chambers 18 and 17 are hydraulically locked so as to hold the new trim adjusted position. When this is reached, the shock absorbing function previously described will still be possible.

To effect trim down operation, the chamber 17 is pressurized and the chamber 18 is opened to return. Actually, the pressure of the driving force of the outboard drive can force the trim down operation without requiring hydraulic assist.

FIG. 1C shows the fully trimmed up position. In this position, the detent balls 28 will be aligned with the recesses 29. At this same time, the trim cylinder 16 will engage a stop at the upper end of the outer cylinder 12 so as to preclude further upward movement.

Tilt-up can be accomplished by continuing to pressurize the chamber 18 and opening the chamber 17 to return. However, since the check valve 32 would preclude the displacement of fluid from the trim cylinder bore 21 by the tilt piston 19, a small valve actuating plunger 34 is provided within the tilt cylinder that unseats the check valve 32 and permits upward movement, as shown in FIG. 1D. When this continues, the retainer 29 will permit the detent balls 28 to be forced outwardly by a spring mechanism, which will be described later by reference to the actual detailed embodiment, and lock the tilt cylinder 16 in position. The reason for doing this will be described later.

Pressurization of the chamber 18 thus forces the floating piston 25 and tilt piston 19 to move upwardly. When this occurs, fluid is displaced past the open check valve 32 back to the return side.

Hence, it should be apparent that the described construction provides a large effective area for trim operation and a smaller but faster operation for tilt-up. However, because of the need to control the flow through the check valve 32, this tilt-up operation is somewhat retarded, and this is another disadvantage of the prior art type of construction. This tilt-up operation continues until the position shown in FIG. 1D.

If tilt-down is then required, the chamber 18 is opened to return, and the chamber 17 may be pressurized. This pressure, however, will not cause the trim cylinder 16 to move downwardly because the detent balls 28 in their receptive grooves 29 will hold the tilt cylinder 16 against movement, and the mechanism will move back to the position shown in FIG. 1D. This permits faster tilt down than if the trim cylinder 16 were also free to move downwardly.

This continues until the floating piston 25 and tilt piston 19 move to the position shown in FIG. 1C, wherein the detent balls 28 can again be released to permit trimming down to the desired position.

Thus, it should be apparent from the described construction that the mechanism in the prior art type of construction requires not only the restrictive check valve 32 in the trim cylinder 16, but also the actuating plunger 34 for relieving the pressure in this chamber. As has been noted, these arrangements add to the complexity and cost of the mechanism. In addition, their flow restrictions can restrict the tilt-up operation.

It is, therefore, a principal object of this invention to provide an improved marine hydraulic tilt and trim control arrangement that does not have these disadvantages.

It is a further object of this invention to provide an improved and simplified tilt and trim control for a marine propulsion system wherein the cost can be reduced and the performance improved.

SUMMARY OF THE INVENTION

This invention is adapted to be embodied in a telescopic tilt and trim hydraulic cylinder arrangement for an outboard drive and watercraft. The arrangement is comprised of an outer cylinder element that is adapted to be affixed to one of the outboard drive and the watercraft and which defines a first internal cavity. A trim cylinder is received and slidably supported within the first internal cavity and defines a second internal cavity. A tilt piston is slidably received in the second internal cavity. A piston rod is affixed to the tilt piston and extends beyond the internal cavities for attachment to the other of the outboard drive and the watercraft. A floating piston is slidable within the second internal cavity and is retained therein between the tilt piston and one end of the trim cylinder on the side opposite the piston rod. Shock-absorbing valve means are provided in the tilt piston for permitting flow across the tilt piston to permit the outboard drive to pop up when an underwater obstacle is struck and to return when the underwater obstacle is cleared. Means are provided for selectively pressurizing the cavity of the outer cylinder element for effecting reciprocal movement of the trim cylinder and the tilt piston for effecting trim adjustment of the outboard drive and for effecting relative movement of the trim piston to the trim cylinder for effecting tilt-up movement of the outboard drive. Latch means are provided for selectively latching one of the pistons for simultaneous movement with the trim cylinder during at least a portion of the movement of the trim cylinder.

DETAILED DESCRIPTION OF THE PREFERRED EMBODIMENTS OF THE INVENTION

Figure 1E:
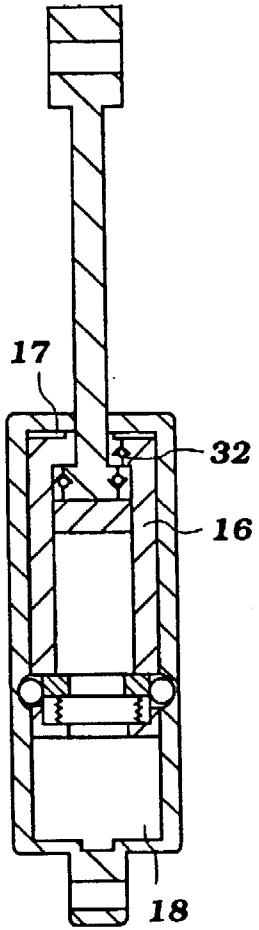
FIGS. 1A through 1E are cross-sectional views of a prior art type of construction of a telescopic tilt and trim hydraulic cylinder shown successively in the fully trimmed down condition through movement to the fully trimmed up, tilted up condition.
Figure 1D:
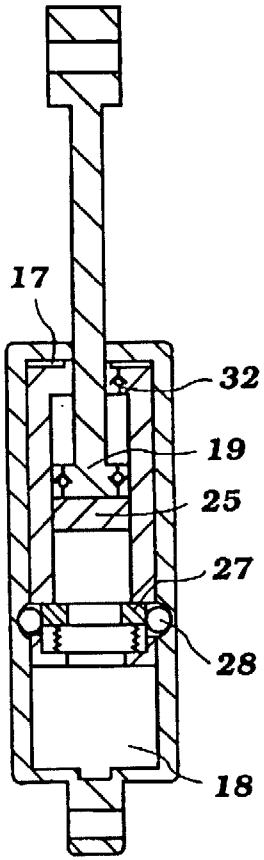
Figure 1C:
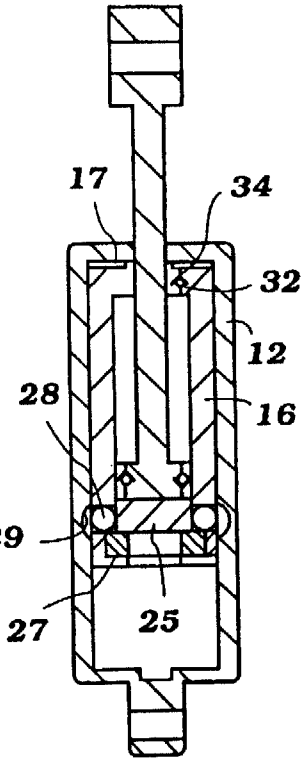
Figure 1C Prior Art
Figure 1B:
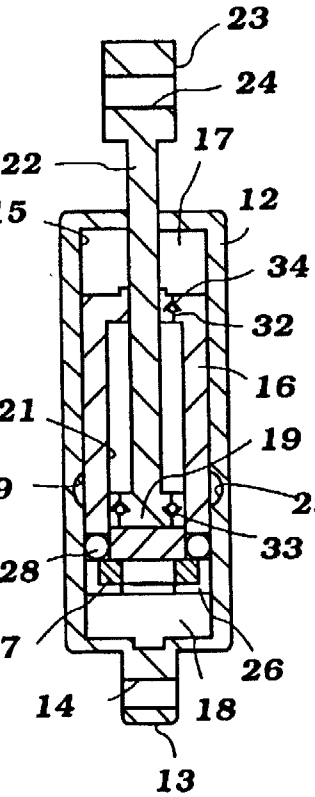
Figure 1A:
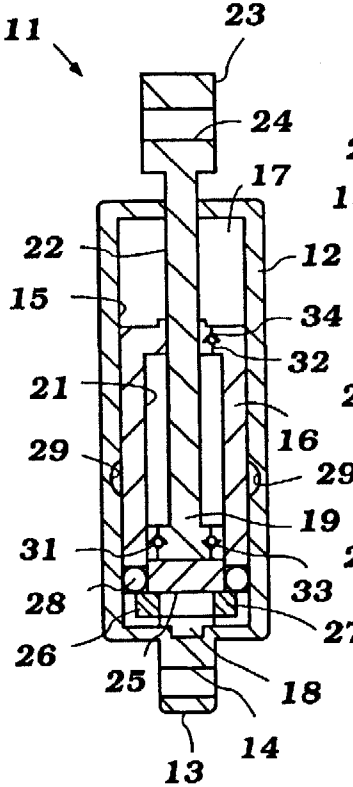
Figure 2:
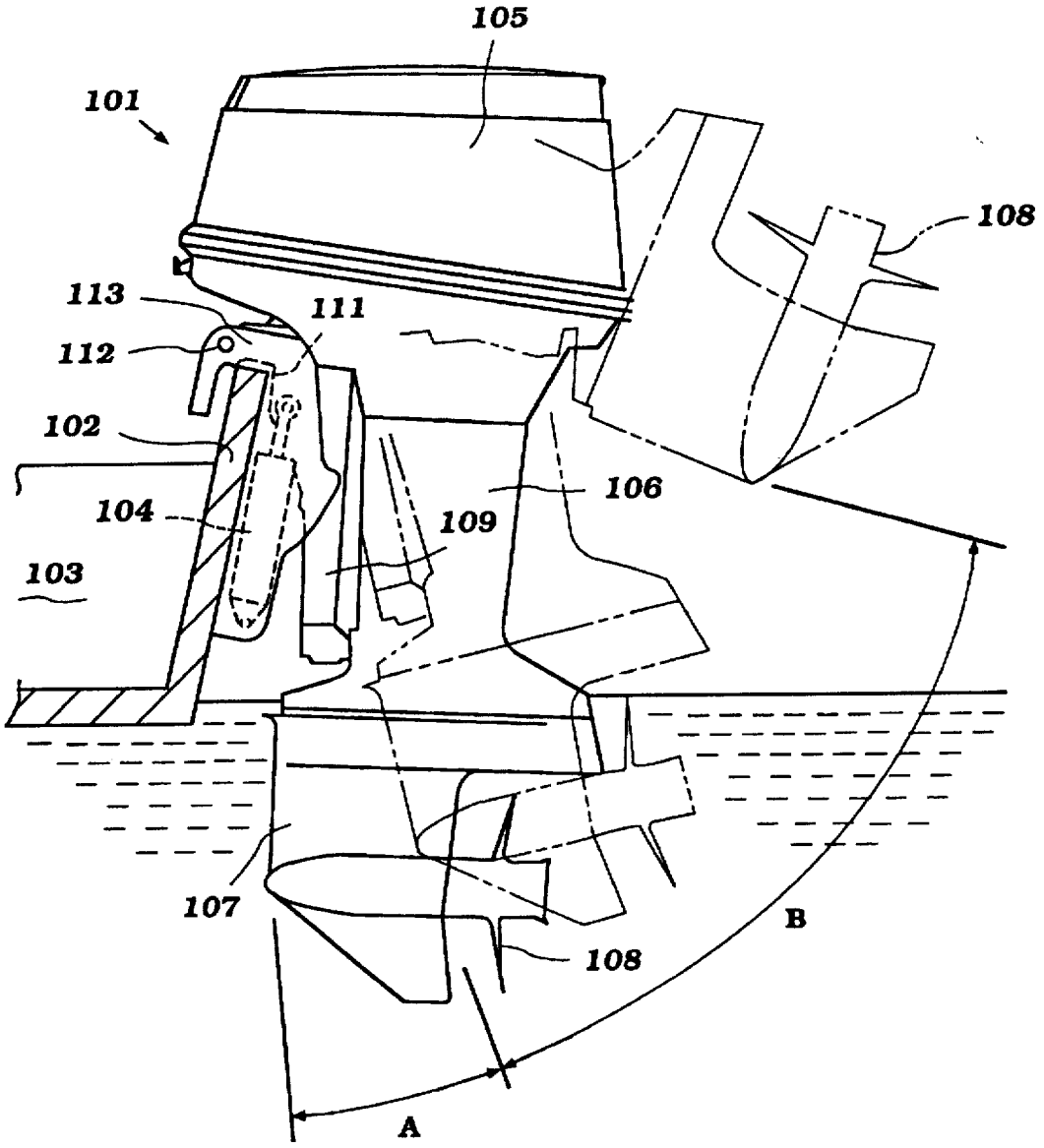
FIG. 2 is a side elevational view of an outboard motor constructed in accordance with an embodiment of the invention as attached to the transom of an associated watercraft shown partially and in section and shows the fully trimmed down condition in the solid line positions, the fully trimmed up position and the tilted up out of water position in phantom.

Referring now in detail to FIGS. 2 through 7 which illustrate a first embodiment of the invention and initially to FIG. 2, an outboard motor constructed in accordance with this embodiment of the invention is identified generally by the reference numeral 101. The outboard motor 101 is shown as attached to a transom 102 of an associated watercraft 103 that is shown partially. The hydraulic tilt and trim adjustment mechanism constructed in accordance with the embodiment of the invention is identified generally by the reference numeral 104 and is shown in more detail in FIGS. 3 through 7. Basically, the attachment of the hydraulic tilt and trim adjustment mechanism 104 to the associated watercraft 103 and its relationship to the outboard motor 101 is the same as the prior art type of devices.

Also, although the invention is described in conjunction with the outboard motor 101, it should be readily apparent that the invention is susceptible of use with other types of outboard drives such as the outboard drive portion of an inboard, outboard drive. It is believed that other usages will be readily obvious to those skilled in the art.

The outboard motor 101 includes a power head 105 which is comprised of a powering internal combustion engine and a surrounding protective cowling. As is typical with outboard motor practice, the engine of the power head 105 is supported so that its output shaft rotates about its vertically extending axis and drives a drive shaft that is journaled within a drive shaft housing 106. None of the internal components of the outboard motor 101 are being illustrated because it will be obvious to those skilled in the art how the invention can be employed with any conventional type of structure.

The drive shaft extends through the drive shaft housing 106 and into a lower unit 107 and there drives a propulsion device such as a propeller 108 through a conventional forward/neutral/reverse transmission. A steering shaft (not shown) is affixed to a drive shaft housing 106 and is supported for steering movement within a swivel bracket 109 in a known manner. The swivel bracket 109 has a forwardly extending portion 111 that is connected by means of a pivot pin 112 to a clamping bracket 113. The clamping bracket 113 is adapted to be detachably affixed to the transom 102 in a well known manner.

The pivotal connection 112 between the clamping bracket 113 and the swivel bracket 109 permits the outboard motor 101 to be moved through a trim adjusted range indicated at A in FIG. 2 wherein the fully trimmed down position is shown in solid lines and the fully trimmed up position is shown in phantom lines. In addition, the outboard motor 101 may be swung through a remaining arc B to a tilted up out of the water position about the pivot pin 112 as is also shown in a phantom line view. The hydraulic tilt and trim adjustment mechanism 104 operates to effect these movements and other movements as will become apparent.

Figure 3:
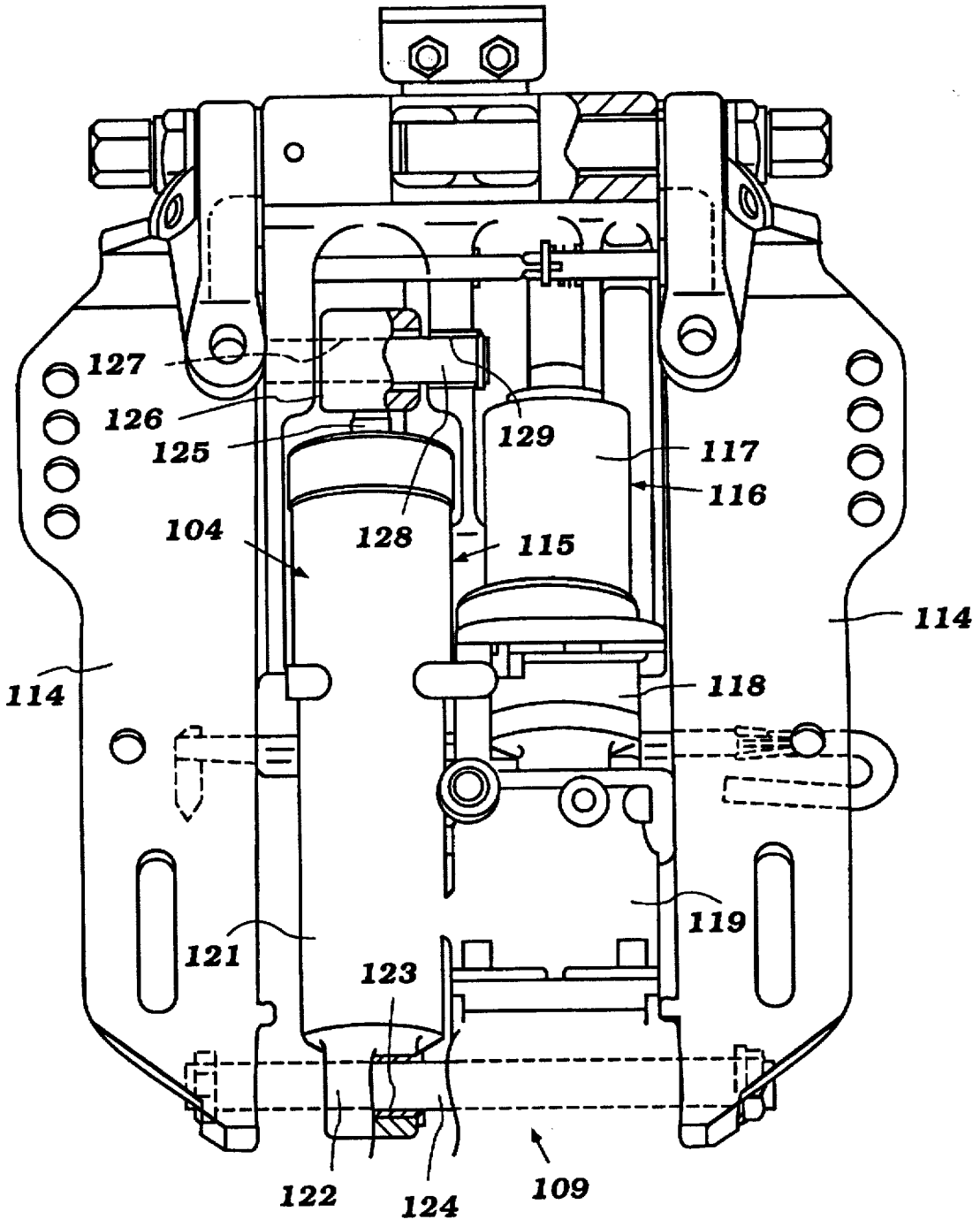
FIG. 3 is an enlarged front elevational view of the hydraulic tilt and trim adjustment mechanism.

The hydraulic tilt and trim adjustment mechanism 104 and its connection to the assembly will now be described by additional reference to FIG. 3. It will be seen that the clamping bracket 113 actually comprises a pair of spaced apart side portions 114 that are mounted on the rear of the transom 102 with the swivel bracket 109 being interposed between them. The hydraulic tilt and trim adjustment mechanism 104 is nested between the brackets 114 so as to provide a compact assembly.

The hydraulic tilt and trim adjustment mechanism 104 is comprised of a hydraulic motor assembly indicated generally by the reference numeral 115 which is disposed adjacent to and which forms an integral part with the powering assembly 116 therefor. The powering assembly 116 includes at its upper end a reversible electric motor 117. A reversible hydraulic pump 118 is disposed below the motor 117 and has a rotor which is driven by the motor 117. A fluid reservoir 119 is disposed beneath the pump 118 and contains hydraulic fluid for the system. In addition, a suitable valve assembly may be incorporated within the pump 118 and the reservoir 119 so as to provide normal pressure relief functions and directional control.

The pump 118 is provided with a pair of outlet ports (not shown) that communicate with inlet ports (not shown) formed in the hydraulic tilt and trim adjusting mechanism 104. It should be noted that the outer housing of the units 104 and 118 may be common or they may comprise separate pieces that are affixed to each other. However, by having the above interfitting ports the necessity for providing external conduits is avoided and the construction is more compact.

Continuing to refer only to the external construction, the hydraulic motor 115 includes an outer cylinder housing 121 having a trunion portion 122 with a bore 123 so as to receive a pin 124 for providing a pivotal connection to the clamping bracket 113 and specifically to the side plates 114 thereof. In addition, a piston rod 125 has a trunion 126 with a bore 127. This piston rod bore 127 receives a further pivot pin 128 that provides a pivotal connection to a bore 129 formed in a portion of a swivel bracket 109 so as to interpose the hydraulic motor assembly 115 therebetween for the tilt and trim movement which will now be described by reference primarily to FIGS. 4 through 7.

The outer cylinder 121 is provided with a bore comprised of three portions, each having a different diameter. These comprise a lower portion 131 which has the smallest diameter and is formed adjacent to the blind end of the cylinder 121. Above the bore 131 is an intermediate larger diameter bore 132. At the upper end bore 132 there is provided a further still larger diameter bore 133 which is closed at its upper end by an end closure and gland assembly 134.

A trim cylinder indicated generally by the reference numeral 135 is slidably supported within these three bores 131,132 and 133 and is formed itself with a lower smaller diameter portion 136 which is contained primarily within the bore 131, but which extends partially in all positions into the bore 132. Above the cylindrical portion 136 there is provided a further portion 137 which has an outer diameter that is complimentary to the outer cylinder bore 132 and which is received in this bore and also in the bore 133 in all of its positions.

The upper end of the trim cylinder 135 is provided with a sealing ring portion 138, which has an outer groove that receives an O-ring 139 for sealing the trim cylinder 135 and the outer cylinder 121 so as to define a first internal upper fluid cavity 141 that is in communication with the pump 118 port through an internal passage which terminates adjacent to the end closure and gland 134 which does not appear in the figures.

It should be noted that since the trim cylinder 135 provides its fluid seal with the upper outer cylinder bore portion 133 close tolerances can be easily maintained because the bore portion 133 is adjacent the end closure and gland 134. Also, a large diameter may be used for the bore 133 and sealing ring 138 in the area above the pump 118 and the reservoir 119 so as to permit a very compact assembly and one which can be easily nested between the clamping bracket side plates 114. This construction is evident from FIG. 3 wherein it is seen that the electric drive motor 117 has a lesser transverse dimension than the pump housing 118 and reservoir 119. Thus, the advantage of this facet of the construction should be readily apparent to those skilled in the art.

Figure 4:
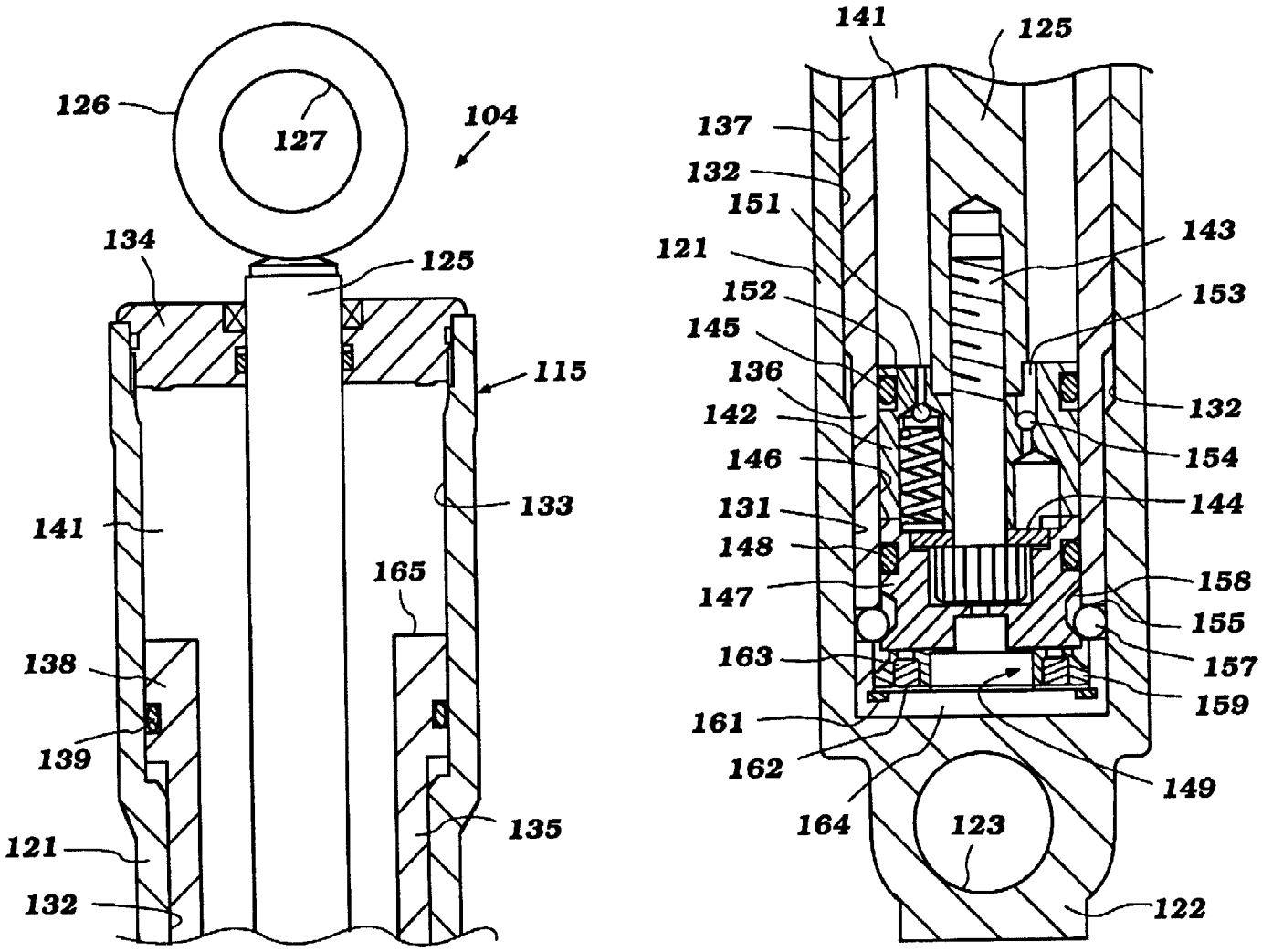
FIG. 4 is a broken cross-sectional view taken through the telescopic tilt and trim hydraulic cylinder constructed in accordance with a first embodiment of the invention.

Continuing to refer to FIG. 4, a tilt piston indicated generally by the reference numeral 142 is affixed to the lower end of the piston rod 125 by means including a threaded fastener 143 which is engaged with a retainer plate 144 which,in turn, holds the body of the tilt piston 142 in place. The tilt piston 142 carries a seal 145 which is in sealing engagement with an internal bore 146 of the trim cylinder 135.

A floating piston 147 is positioned within the trim cylinder bore 146 below the tilt piston 142. The floating piston 147 carries a seal 148 for providing sealing engagement with the trim cylinder bore 146. The floating piston 147 may move axially within the trim cylinder bore 146 but its lower most position is limited by a latching mechanism that is indicated by the reference numeral 149 and retaining mechanism which mechanisms will be described later.

A shock valving passage 151 extends through the tilt piston 142 and a pressure responsive absorber valve 152 permits restricted flow from the first upper fluid internal cavity 141 to the cavity formed between the tilt piston 142 and the floating piston 147 so as to permit the outboard motor 101 to pop up when an underwater obstacle is struck. When the underwater obstacle is cleared, the outboard motor 101 may again return to its trim adjusted position by fluid flow from the area between the tilt piston 142 and the floating piston 147 to a let down valving means passage 153 formed in the tilt piston 142. The flow through the passage 153 is controlled by a light absorber check valve 154.

The latch mechanism 149 is provided at the lower end of the trim cylinder 135 for latching the trim cylinder 135 in its fully trimmed up position and to latch the floating piston 147 for movement with the trim cylinder 135 for a portion of its stroke. To this end, the lower end of the trim cylinder 135 is provided with a number of cylindrical bores 155. Detent locking balls 157 are received within each of these bores 155 and are normally biased radially outwardly through cooperation with a circumferentially extending groove 158 formed around the lower end of the floating piston 147.

A biasing plate 159 is caged within the lower end of the trim cylinder 135 immediately below and in contact with the lower surface of the floating piston 147 by means of a snap ring 161 received within a groove therein. During a position of the stroke of the mechanism the biasing plate urges the floating piston 147 to a locked condition with the balls 157 as seen in FIGS. 4 and 5A–C.

The biasing plate 159 is provided with a number of axially extending bores 162 that receive coil compressing springs 163 that are engaged with the snap ring 161 and normally urge the biasing plate 159 upwardly against the lower surface of the floating piston 147. Their latching functions will be described shortly by reference to FIGS. 5A–5E and FIGS. 6 and 7.

A second internal fluid cavity 164 is formed by the outer cylinder bore 131 below the tilt piston 142 and which can communicate with the underside of the floating piston 147 through the central opening in the retaining ring 161.

The operation of the telescoping tilt and trim hydraulic adjustment mechanism 104 and specifically the hydraulic fluid motor portion 115 thereof will now be described with additional reference to FIGS. 5A–5E and FIGS. 6 and 7, with the FIGS. 5A–5E corresponding to the same positions as shown in the prior art arrangement of FIGS. 1A–1E.

Figures 5A, 5B, 5C, 5D, 5E:
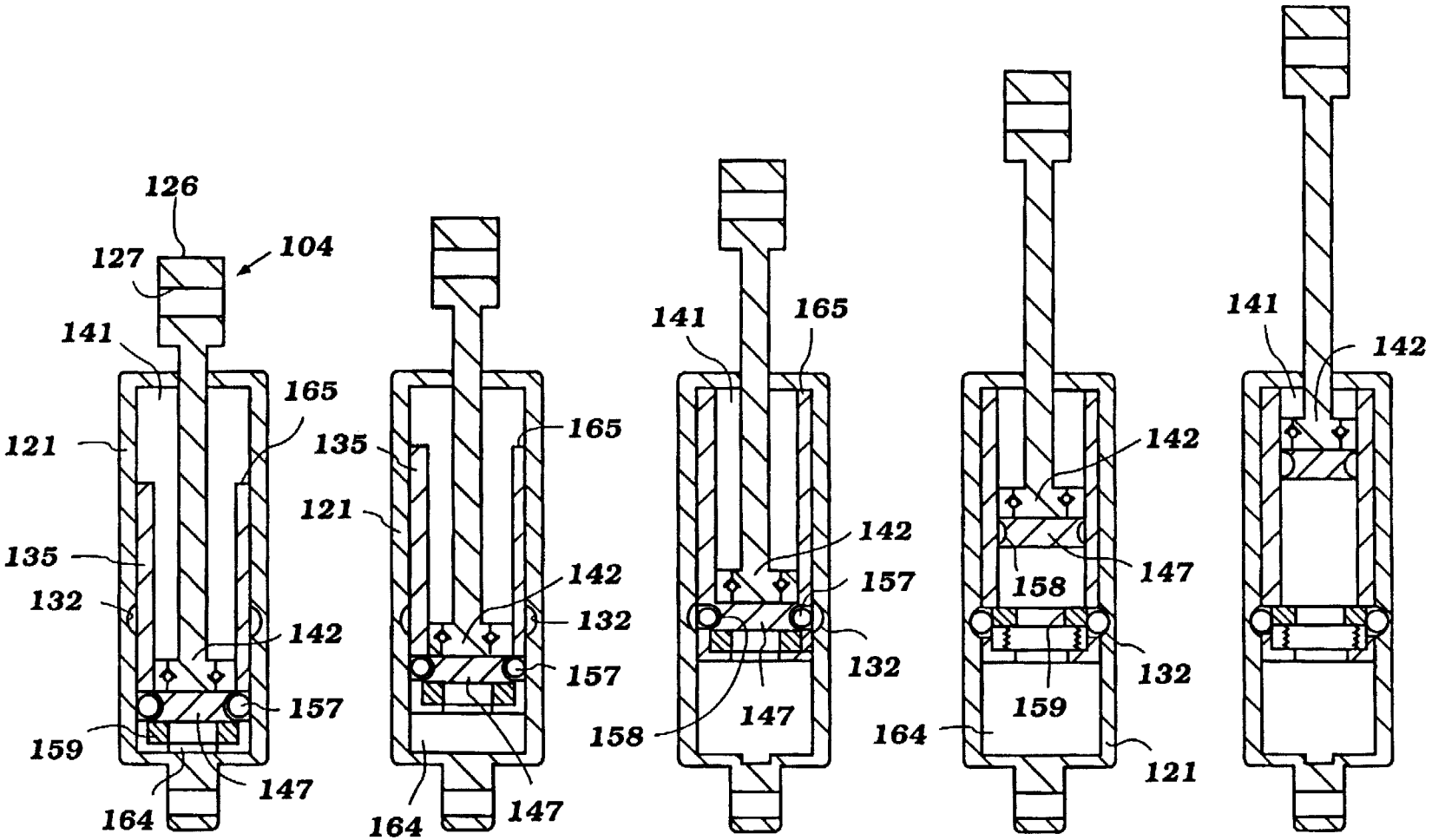
FIGS. 5A through 5E are cross-sectional views similar to FIGS. 1A through 1E and illustrate the movement of this embodiment of the invention.

FIG. 5A shows the fully trimmed down position which corresponds to the solid line view of FIG. 2. If it is desired to turn the outboard motor 101 up through the range A as shown in FIG. 2, the system is pressurized so as to introduce fluid under pressure to the second internal cavity 164 beneath the trim cylinder 135 and vent the upper first internal cavity 141 back to the return side of the pump 118. Since the piston rod 125 extends through the first internal cavity 141 more fluid will be required to cause trim of movement than is displaced from the cavity 141 and this made-up fluid is made up from the reservoir 119. When the second internal cavity 164 is pressurized, the pressure will act on the floating piston 147 and urge it upwardly along with the interlocked trim cylinder 135. Since the floating piston 147 is interlocked with the trim cylinder 135, it is unnecessary to establish a fluid lock above the tilt piston 142 to insure this simultaneous movement. Thus the check valved passageway 32 of the prior art construction (FIG. 1) can be eliminated. Also the upper end of the trim cylinder 137 need not be closed. In fact in this embodiment the upper end of the trim cylinder 137 is completely open. This eliminates the need for a costly seal at the upper end of the trim cylinder 137 around the piston rod 125.

As with the prior art type of arrangements, the effective fluid area is the area of the trim cylinder but since the seal 139 between the trim cylinder 135 and the outer cylinder 121 is disposed on the sealing ring 138, a larger diameter effective area is provided. That is, the effective area of the trim cylinder 135 is not the area displaced by either the cylindrical portions 136 or 137 but actually the area of the ring 138. This does not appear in FIGS. 5A–5E or FIGS. 6 and 7 but is evident in FIG. 4.

This upward movement can continue throughout the trim range A until the trim cylinder 135 reaches its uppermost position. At the time that this happens the detent balls 157 which have been engaged with the cylinder bore 131 are free to move into the area of the cylinder bore 132. The balls 157 will not be moved to their engaged position at this time, however, since no relative motion between the trim cylinder 135 and the floating piston 147 has as yet occurred and hence the detent balls 157 are shown retracted in FIG. 5C. That is, the locking of the trim cylinder 135 in position does not occur immediately when the trim cylinder 135 moves to the position at the end of the trim-up adjustment. The trim cylinder 137, however, can move no higher because its open upper end 165 will engage the outer cylinder end closure 134 (FIG. 5C).

Figure 6:
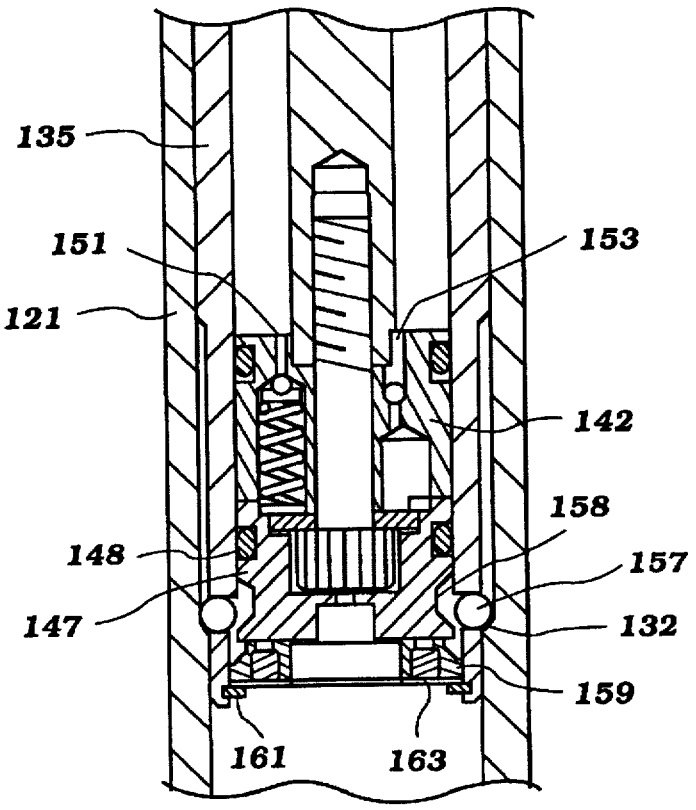
FIG. 6 is a partial cross-sectional view showing the lower end of the trim cylinder of the telescopic tilt and trim hydraulic cylinder in its fully trimmed up position.

Once the outboard motor 101 has been fully trimmed up to the end of its range as shown in the lower phantom line view of FIG. 2, if the operator desires to achieve tilt-up then the second internal cavity 164 is again pressurized or is continued to be pressurized. When this occurs the floating piston 147 will be urged upwardly as shown in FIG. 6 so as to urge the detent balls 157 out of the groove 158 in the floating piston 147 and into engagement with the larger diameter bore portion 132 of the outer cylinder 121 which is depicted in FIGS. 5A–5E as a detent recess. This also releases the latching between the floating piston 147 and the trim cylinder 135.

Figure 7:
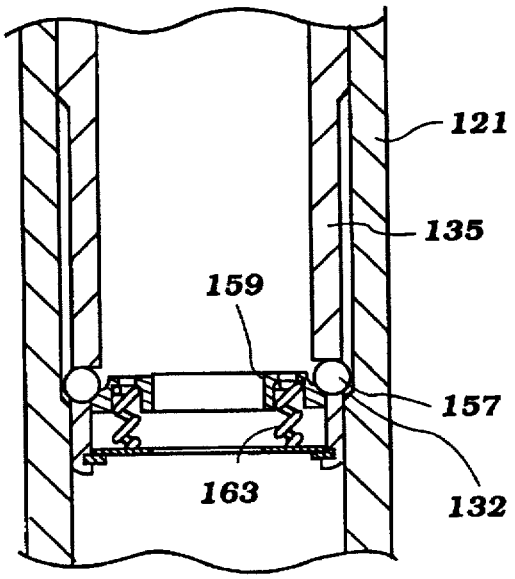
FIG. 7 is a partial cross-sectional view similar to FIG. 6 and shows the fully tilted up position and the latching mechanism in its latched position.

Although it is possible to form this outer cylinder latch as merely a detent recess, for machining simplicity the portion 132 actually is a larger diameter bore as shown accurately in FIG. 4 and only schematically in FIGS. 5A–5E. The upward motion of the floating piston 147 beyond the detent balls 157 allows the springs 163 to expand and move the plate 159 upwardly so as to continually press the detent balls 157 into engagement with the larger diameter bore portion 132 as shown in FIG. 7.

The floating piston 147 and tilt piston 142 may then continue to move upwardly as further fluid is displaced from the first internal cavity 141 and through the return conduit aforedescribed. This movement can continue until the fully tilted-up position as shown in FIG. 5E is reached. In this position the detent balls 157 will act to lock the trim cylinder 135 against downward movement, as shown in FIG. 7, even if there is no fluid pressure existent in the second internal cavity 164. Thus, the system cannot float downwardly due to the locking of the trim cylinder 135 in position.

When it is desired to effect the tilt-down the first internal cavity 141 is pressurized and this will cause the tilt piston 142 and floating piston 147 to move downwardly from the position shown in FIG. 5E to the position shown in FIG. 5D and finally to the position shown in FIG. 5C. When the position of FIG. 5C is reached the biasing plate 159 will have been moved downwardly by the floating piston 147. This movement compresses the springs 163 and causes the detent balls 157 to be cammed out of the engagement with the bore portion 132 of the outer cylinder 121 and move into the groove 158 of the floating piston 147 to again latch the trim cylinder 135 to the floating piston 147. Continued movement can then be used so as to adjust the trim position as desired.

In this embodiment shock absorbing or popping up action occurs in a manner similar to the prior art constructions. The fluid displaced on popping up, however, can freely move into the area above the trim cylinder 135.

Thus, it is clear that the above-described tilt and trim control arrangement provides the same functionality as the prior art type arrangements but in a manner that is not only faster, but is accomplished by a structure that is both simpler and less expensive.

Figure 8:
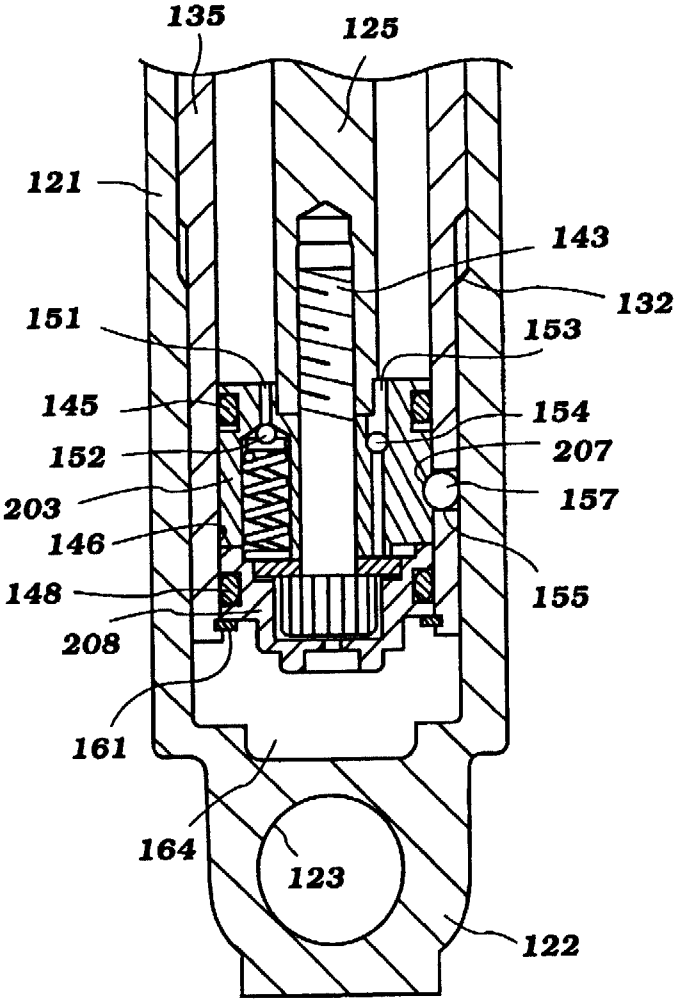
FIG. 8 is a broken cross-sectional view similar to FIG. 4 and shows a second embodiment of the invention.
Figure 8:
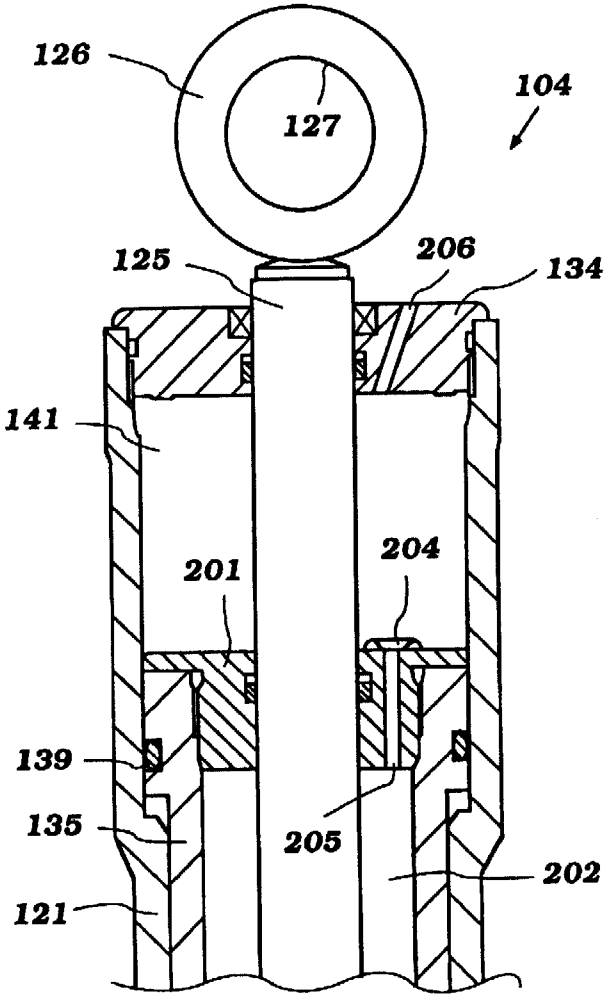

FIGS. 8 and 9 illustrate a further embodiment of the invention in which the trim cylinder and the latching mechanisms have been altered. Since the tilt and trim control arrangement shown in FIGS. 8 and 9 is similar to the arrangement shown in FIGS. 2–7 only those components that are new or whose design has been significantly altered will be referred to by a new reference number. All other components will be referred to by the reference number of the previous embodiment.

As best seen in FIG. 8, an end closure and gland 201 sealingly engages the upper end of the trim cylinder 135 and thus provides for a further internal cavity 202 bounded by the end closure and gland 201 at its upper end and the tilt piston, which is indicated by reference numeral 203, at its lower end. A stop 204 is disposed on the upper surface of the end closure and gland 201 while a large unrestricted passage 205 is provided through the end closure and gland 201 so as to allow free fluid transfer between the cavities 141 and 202 for a reason which will be described later. Additionally, the return passage 206 is provided through the end closure and gland 134 that closes the larger diameter bore 132 of the outer cylinder 121 and will be used in conjunction with the passage 205.

The construction of the tilt piston 203 is identical to that utilized in the previous embodiment with the exception that a groove 207 is formed circumferentially about the lower end of the piston 203. Thus, the performance of the tilting and trim hydraulic adjustment mechanism is similar to that of the prior art and first embodiment mechanisms in those instances where an underwater obstacle is struck by the outboard motor 11, and will not be further elaborated upon except to point out how this embodiment provides a greater effective area for its shock absorbing function.

The tilt piston groove 207 cooperates with the bores 155 formed at the lower end of the trim cylinder 135 to house the detents 157 within the slots 155 when the trim cylinder 135 is in an unlocked condition from the outer cylinder so as to permit movement of the trim cylinder 135. The trim cylinder 135 is, however, locked for movement with the tilt piston 203 at this time. This condition is shown in FIG. 8 and in FIGS. 9A–9C. Thus, the trim piston 203, groove 207, lower trim cylinder 135 and bores 155 together comprise a new latching mechanism for the current embodiment.

The floating piston is indicated by reference numeral 208 and is positioned within the tilt piston cylinder bore 146 of the trim cylinder 135 and carries the seal 148 for providing sealing engagement therewith. The lowermost portion of the floating piston 208 is limited by the snap ring 161.

The operation of the above-described tilt and trim hydraulic adjustment mechanism 104 will now be described in detail with reference to FIGS. 8 and FIGS. 9A through 9E with the FIGS. 9A through 9E corresponding to the same positions as shown in the arrangement of FIGS. 5A through 5E.

Figure 9E:
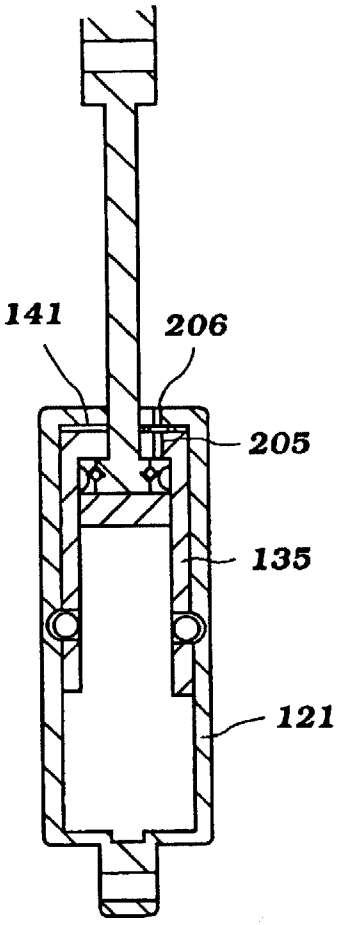
FIGS. 9A through 9E are cross-sectional views similar to 5A through 5E and illustrate the corresponding positions of the second embodiment of the invention.
Figure 9D:
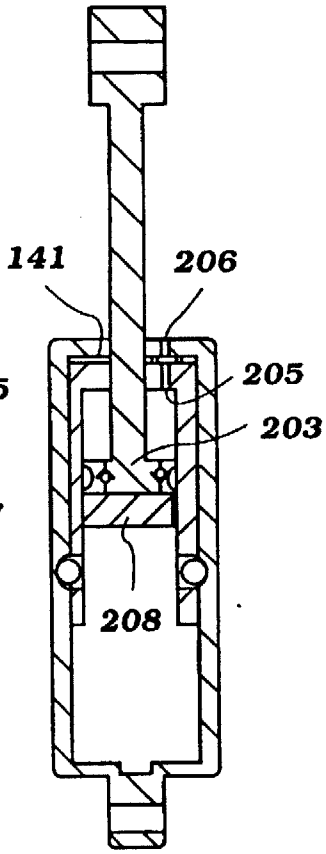
Figure 9C:
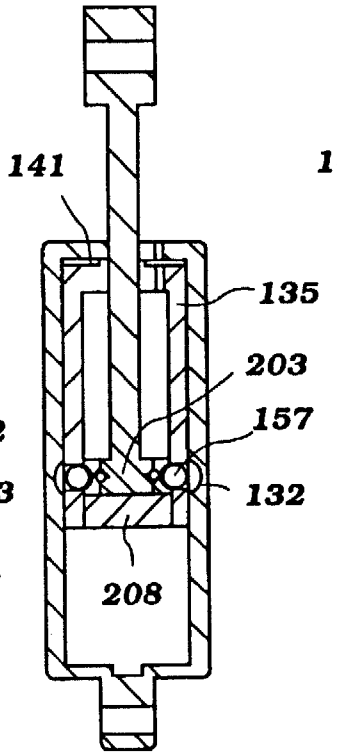
Figure 9B:
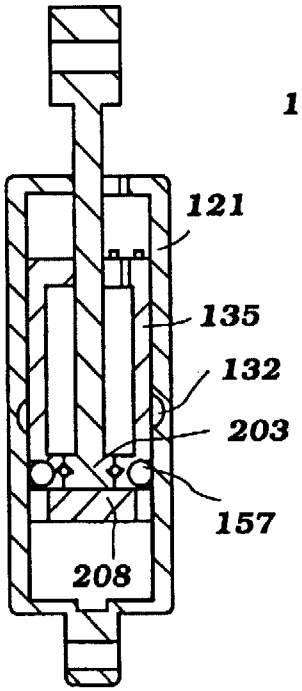
Figure 9A:
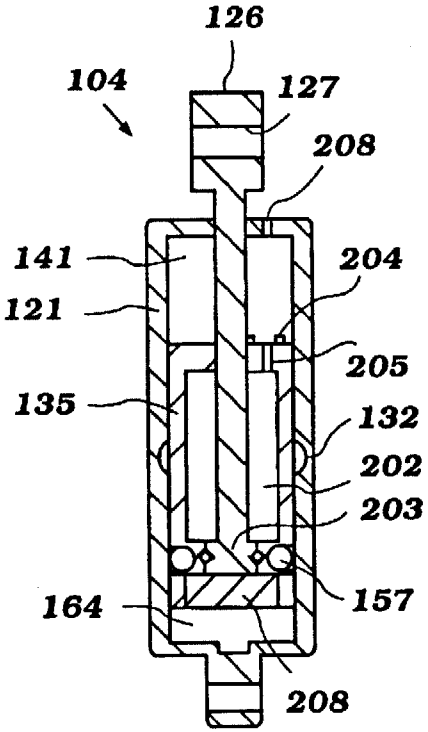

FIG. 9A shows the fully trimmed down condition which corresponds to the solid line view of FIG. 2. If it is desired to trim the outboard motor 101 up through the range A as shown in FIG. 2, the system is pressurized so as to introduce fluid under pressure to the second internal cavity 164 beneath the trim cylinder 135 and vent the first internal cavity 141 back to the return side of the pump 118. Since the piston rod 125 extends through the first internal cavity 141 more fluid will be required to cause trim-up movement than is displaced from the cavity 141 and this made-up fluid is made up from the reservoir 119. When the second internal cavity 164 is pressurized, the pressure will act on the floating piston 208 and urge it upwardly along with the interlocked trim cylinder 135. This upward movement can continue throughout the trim range A until the trim cylinder 135 reaches its uppermost position where the stop 204 contacts the lower surface of the end closure and gland 134.

When this happens, the detent balls 157, which have been engaged with the cylinder bore 131, will be free to move into the area of the cylinder bore 132. The detent balls 157 will not be moved to their engaged position at this time, however, since no relative motion between the trim cylinder 135 and the tilt piston 203 has as yet occurred and hence the detent balls 157 are shown retracted in FIG. 9C. That is, locking of the trim cylinder 135 in position does not occur immediately when the trim cylinder 135 moves to the position at the end of the trim-up adjustment.

Once the outboard motor 101 has been fully trimmed up to the end of its range as shown in the lower phantom line view of FIG. 2, if the operator desires to achieve tilt-up then the second internal cavity 164 is again pressurized or is continued to be pressurized. When this occurs, the floating piston 208 will be urged upwardly as shown in FIG. 8 and will force the tilt piston 203 upwardly. Since the tilt cylinder 135 is held against further movement by the stop 204 this urges the detent balls 157 out of the groove 207 and into engagement with the larger diameter bore 132 of the outer cylinder 121 as depicted in FIGS. 9D and 9E.

The floating piston 208 and tilt piston 203 may then continue to move upwardly since the passage 205 allows for the open communication of fluid from the internal cavity 202 to the reservoir 119 through the passage 206. This movement can continue until the fully tilted up position shown in FIG. 9E is reached. In this position, the detent balls 157 will act to lock the trim cylinder 135 against downward movement even if there is no fluid pressure existent in the second internal cavity 164. Thus, the system cannot float downwardly due to the locking of the trim cylinder 135 in position. It should be noted that the inner ends of the bores 155 in which the balls 157 are located are either slightly reduced in diameter or are provided with retainer rings so that the balls 157 will not fall out at this time. This retention should be such that it does not interfere with the ability of the balls 157 to function to latch the tilt piston 203 to the trim cylinder 135.

When it is desired to effect tilt down, the cavity 141 is pressurized by means of the passage 206, which allow fluid supplied from the reservoir 119 and pumped by the pump 118 and into the first internal cavity 141. Since initially the tilt cylinder is locked against downward movement, this fluid will flow freely into the cavity 202 through the passage 205. The passage 206 is angled so as to directly align with the passage 205 through the stop surface 204 when the trim cylinder 135 is against the end gland 134.

This pressurization will cause the tilt piston 203 and floating piston 208 to move downwardly from the position shown in FIG. 9E to a position shown in FIG. 9D and finally to the position shown in FIG. 9C. Once the position of FIG. 9C is reached the detent balls 157 can be cammed out of the bore portion 132 of the outer cylinder 121 and through the slots 155 in the trim cylinder 135 by further downward movement. Pressure caused by the continued pumping of fluid by the pump 118 to the first internal cavity 141, of the tilt piston 203 and the floating piston 208, which is in contact with the snap ring 161 and causes the now latched trim cylinder 135 to also move downwardly at this time. Thus, the above tilt and trim control arrangement provides for the same functionality as the prior arrangement but with a much simplified latching mechanism.

Since the trim cylinder 135 is latched to the tilt piston 203 in this embodiment, both members will move upwardly when an underwater obstacle is struck. Thus the effective area of the shock absorber is increased to provide greater damping. This is achieved without reducing the speed of tilt up since the effective piston area is reduced during tilt up action.

From the foregoing description, it should be readily apparent that the above-described embodiments provide tilt and trim adjustment mechanisms that are not only very compact but are also of a simpler and less expensive construction. Of course, it is to be understood that the foregoing description is that of preferred embodiments of the invention and that various changes and modifications may be made without departing from the spirit and scope of the invention as defined by the appended claims.

What is claimed is:

1. A telescopic tilt and trim hydraulic cylinder arrangement for an outboard drive and watercraft comprised of an outer cylinder element adapted to be affixed to one of the outboard drive and the watercraft and defining a first internal cavity, a trim cylinder received and slidably supported within said first internal cavity and defining a second internal cavity, a tilt piston slidably received in said second internal cavity, a piston rod affixed to said tilt piston and extending beyond said internal cavities for attachment to the other of the outboard drive and the watercraft, a floating piston slidable within said second internal cavity and restrained therein between said tilt piston and one end of said trim cylinder on a side opposite to said piston rod, valving means in said tilt piston for effecting shock-absorbing flow of fluid across the sides of said tilt piston for permitting popping up of said outboard drive when an underwater obstacle is struck with sufficient force and for permitting said outboard drive to return to its trim-adjusted position after the object is cleared, means for selectively pressurizing said first cavity for effecting reciprocal movement of said trim cylinder and said tilt cylinder for effecting trim adjustment of said outboard drive and effecting relative movement of said tilt piston to said trim cylinder for effecting tilt-up movement of said outboard drive, and latching means for selectively interlocking one of said pistons for simultaneous movement with said trim cylinder during at least a portion of the movement of said trim cylinder.

2. A telescopic tilt and trim hydraulic cylinder arrangement as defined in claim 1, wherein the latching means cooperates with the floating piston.

3. A telescopic tilt and trim hydraulic cylinder arrangement as defined in claim 2, wherein the interlocking of the floating piston to the trim cylinder effects movement of the tilt piston along with the floating piston and the trim cylinder on trim and tilt-up operation.

4. A telescopic tilt and trim hydraulic cylinder arrangement as defined in claim 3, wherein the latching means comprises a plurality of detent balls cooperating directly between the floating piston and the trim cylinder.

5. A telescopic tilt and trim hydraulic cylinder arrangement as defined in claim 1, wherein the latching means cooperates directly between the tilt piston and the trim cylinder.

6. A telescopic tilt and trim hydraulic cylinder arrangement as defined in claim 5, wherein the latching means comprises a plurality of detent balls directly cooperating between the tilt piston and the trim cylinder.

7. A telescopic tilt and trim hydraulic cylinder arrangement as defined in claim 1, further including further latching means for interlocking the trim cylinder relative to the outer cylinder element for retaining the trim cylinder in a predetermined position.

8. A telescopic tilt and trim hydraulic cylinder arrangement as defined in claim 7, wherein the further latching means for effecting releasable interlocking of the trim cylinder latches the trim cylinder in one of its extreme positions.

9. A telescopic tilt and trim hydraulic cylinder arrangement as defined in claim 8, wherein the one extreme position is the position corresponding to the fully trimmed up position.

10. A telescopic tilt and trim hydraulic cylinder arrangement as defined in claim 9, wherein the further latching means for effecting releasable interlocking is not latched in its latched position until fluid pressure for effecting tilt-up operation is applied to the tilt piston.

11. A telescopic tilt and trim hydraulic cylinder arrangement as defined in claim 7, wherein the first-mentioned latching means and the further latching means include the same latching elements.

12. A telescopic tilt and trim hydraulic cylinder arrangement as defined in claim 11, wherein the latching means cooperates with the floating piston.

13. A telescopic tilt and trim hydraulic cylinder arrangement as defined in claim 12, wherein the interlocking of the floating piston to the trim cylinder effects movement of the tilt piston along with the floating piston and the trim cylinder on trim and tilt-up operation.

14. A telescopic tilt and trim hydraulic cylinder arrangement as defined in claim 13, wherein the latching means comprises a plurality of detent balls cooperating directly between the floating piston and the trim cylinder.

15. A telescopic tilt and trim hydraulic cylinder arrangement as defined in claim 11, wherein the latching means cooperates directly between the tilt piston and the trim cylinder.

16. A telescopic tilt and trim hydraulic cylinder arrangement as defined in claim 15, wherein the latching means comprises a plurality of detent balls directly cooperating between the tilt piston and the trim cylinder.

17. A telescopic tilt and trim hydraulic cylinder arrangement as defined in claim 1, wherein the other end of the trim cylinder is in open communication with the first internal cavity in the area where the piston rod extends through the first internal cavity.

18. A telescopic tilt and trim hydraulic cylinder arrangement as defined in claim 17, wherein the outer periphery of the trim cylinder is spaced from the piston rod by a substantial distance.

19. A telescopic tilt and trim hydraulic cylinder arrangement as defined in claim 18, wherein the distance between the piston rod and the trim cylinder is equivalent to the radius of the tilt piston.

20. A telescopic tilt and trim hydraulic cylinder arrangement as defined in claim 17, wherein the open communication between the trim cylinder cavity and the first cavity is provided by a passage extending through an end of the trim cylinder.

* * * * *